US007204330B1

(12) United States Patent
Lauren

(10) Patent No.: US 7,204,330 B1
(45) Date of Patent: Apr. 17, 2007

(54) BATTERY-POWERED, REMOTE-CONTROLLED, MOTOR-DRIVEN, STEERABLE ROLLER SKATES

(76) Inventor: Nick Lauren, 104-40 Queens Blvd., Apt. 17J, Forrest Hills, NY (US) 11375

( * ) Notice: Subject to any disclaimer, the term of this patent is extended or adjusted under 35 U.S.C. 154(b) by 0 days.

(21) Appl. No.: 11/449,322

(22) Filed: Jun. 8, 2006

(51) Int. Cl.
*A63C 17/12* (2006.01)

(52) U.S. Cl. ..... 180/181; 180/65.1; 280/11.27

(58) Field of Classification Search ..... 280/11.115, 280/11.27, 87.042; 180/180, 181
See application file for complete search history.

(56) References Cited

U.S. PATENT DOCUMENTS

| | | | | |
|---|---|---|---|---|
| 4,171,592 | A | 10/1979 | Saitoh | 46/235 |
| 4,846,752 | A | 7/1989 | Combs | 446/279 |
| 5,048,632 | A * | 9/1991 | Battel | 180/181 |
| 5,183,277 | A * | 2/1993 | Tang | 280/11.28 |
| 5,236,058 | A | 8/1993 | Yamet et al. | 180/181 |
| 5,330,026 | A | 7/1994 | Hsu et al. | 180/181 |
| 5,722,873 | A | 3/1998 | Ishimoto | 446/456 |
| 5,797,466 | A | 8/1998 | Gendle | 180/181 |
| 5,829,543 | A | 11/1998 | Diaz | 180/181 |
| 6,050,357 | A * | 4/2000 | Staelin et al. | 180/65.1 |
| 6,059,062 | A * | 5/2000 | Staelin et al. | 180/181 |
| 6,074,271 | A * | 6/2000 | Derrah | 446/457 |
| 6,428,050 | B1 * | 8/2002 | Brandley et al. | 280/809 |
| 6,726,523 | B2 * | 4/2004 | Baker et al. | 446/225 |
| 7,040,638 | B2 * | 5/2006 | Cole | 280/87.042 |
| 7,053,288 | B2 * | 5/2006 | Iwai et al. | 84/600 |
| 2003/0214103 | A1 | 11/2003 | Walker | 280/11.203 |
| 2004/0163867 | A1 | 8/2004 | Hillman | |
| 2006/0170174 | A1 * | 8/2006 | Hiramatsu | |

* cited by examiner

*Primary Examiner*—Christopher Bottorff
(74) *Attorney, Agent, or Firm*—Bernard S. Hoffman

(57) ABSTRACT

Battery-powered, remote-controlled, motor-driven, steerable roller skates. Each skate includes a boot, a transmitter, a base, a driving mechanism, a steering mechanism, a controller, and a receiver. The boot is worn on a foot of a user. The transmitter is battery-powered, is held by the user, and transmits wireless signals for controlling speed, steering, forward and reverse motion, and combinations thereof. The base has the boot sitting thereon. The driving mechanism is battery-powered, motor-driven, and operatively connected to, and selectively moves, the base with the boot thereon. The steering mechanism is battery-powered, motor-driven, and operatively connected to, and selectively steers, the base with the boot thereon. The controller is battery powered, disposed in the base, and operatively connected to, and selectively activates, the driving mechanism and the steering mechanism. The receiver is battery-powered, disposed in the base, and operatively connected to, and selectively activates, the controller by receipt of the wireless signals from the transmitter so as to allow the base with the boot thereon to move and steer by remote-control.

9 Claims, 3 Drawing Sheets

BATTERY-POWERED, REMOTE-CONTROLLED, MOTOR-DRIVEN, STEERABLE ROLLER SKATES

1. BACKGROUND OF THE INVENTION

A. Field of the Invention

The present invention relates to roller skates, and more particularly, the present invention relates to battery-powered, remote-controlled, motor-driven, steerable roller skates.

B. Brief Description of the Prior Art

There has been an increasing interest in recent years in providing alternate ways of transportation of people. This is of particular concern in urban areas where the streets have become increasingly crowded with automobiles. The automobile population increase has caused congestion and substantial increases in air and noise pollution. One of the major problems with the use of automobiles is that the amount of fuel consumed in their operation is proportion to their entire weight, that is, the weight of the people and goods being transported as well as the weight of the automobile itself. Where many people and/or much goods are being transported, there is a reasonable relationship between the amount of fuel being consumed, the amount of pollution being created, and the total weight of the material/people being transported. Where a large and heavy car is used to transport a single person, a disproportionate amount of fuel is needed to move the weight of the car as compared to the amount that actually is needed to move the weight of the person and goods in the car.

In recent years there has been an effort to reduce the weight and size of cars and thereby increase their fuel efficiency. There have also been efforts to encourage the use of multiple occupancy vehicles in order to increase the proportion of the weight of passengers and freight to the weight of the vehicle itself.

Public transportation is, of course, one solution to this problem. Many people, however, do not like to use public transportation, and will not if they can use their cars. Further, even where public transportation is used, there is often some distance between the public transportation stop and the ultimate destination of the rider. These deficiencies raise a need for alternative transportation ways.

In other countries, and to a lesser extent here in the United States, bicycles, even motored bicycles known as mopeds have been used to transport people. This is much more efficient from a fuel conservation perspective, but bicycles still take up a fair amount of room on the streets, several times as much room as the person riding the bicycle would take up if that person was walking.

While all of these efforts are admirable, there is still need to provide more efficient transportation, which will reduce the amount of fuel needed per weight of people and goods being transported.

Roller skates are well known. They have been available for many decades. In the older type of skate, four wheels are mounted two each on two axles, one in front of the other. In the newer type of skate, each of the wheels is mounted on its own axle, and all of the wheels are mounted in tandem. This newer roller skate is also referred to as a roller blade.

Roller skates are suitably directly coupled to a shoe as a single integral unit, or they may be made so as to be attachable to a shoe. These configurations are equally adapted to implementation with either the two axle, two wheel per axle, or the roller blade type of arrangement.

It has always been the desire of skaters to go faster. Toward this end, skates have become lighter and their construction has been modified so as to minimize friction. Also, in the past, many attempts have been made to provide auxiliary propelling apparatus for skates.

Many of these auxiliary propelling apparatuses for roller skate have to be carried on the person of the skater, that is on a belt or on the back of the skater in the form of an electric motor or an internal combustion engine. Power transmission between the motor/engine and the skate has often been provided by way of a rigid or a flexible power transmission apparatus, such as a shaft or cable.

It is clearly undesirable for such a motor/engine to be carried on the back or the belt of the skater. The power transmission is too long and therefore too much power is lost in the transmission. Further, and perhaps more importantly, the attitude of the skater does not always coincide with the attitude of the roller skates, which may make for either a very complicated power transmission system, or one which may be subject to interruption when the motor/engine being carried by the skater and the roller skates get too far out of functional alignment.

It is therefore believed that it is more appropriate and efficient to provide a way for driving (powering) roller skates, which is more proximate to the skate itself. This would be less subject to power transmission failure or interruptions because of these attitudinal differences between the skates and the skater.

Electric motors are advantageous in that they start instantaneously, without cranking, and they do not require the skater to carry a flammable, often dangerous, fuel around to feed the motor.

Numerous innovations for motor driven skates, skate boards, and toy cars and skates have been provided in the prior art that will be described below, and which are incorporated herein by reference thereto. Even though these innovations may be suitable for their specific purposes, they each differ in structure and/or operation and/or purpose from the present invention in that they do not teach battery-powered, remote-controlled, motor-driven, steerable roller skates.

(1) U.S. Pat. No. 4,171,592 to Saitoh.

U.S. Pat. No. 4,171,592 issued to Saitoh on Oct. 23, 1979 in class 46 and subclass 235 teaches a toy car operated by a wireless electric device and includes a car and a wireless electric transmitter in separation. All apparatus including a driving apparatus and a braking apparatus are mounted on a bottom plate of the car. A pair of front wheels of the driving apparatus are mounted on a front axle that is journaled in both sides of an axle support frame. The axle support frame is pivoted on the bottom plate. The braking apparatus includes a receiver, an electromagnet, and a pair of brake disks. A sliding frame is adapted to slide laterally on the axle support frame, and is equipped with the electromagnet having a pair of magnet cores. Each of the brake disks is fixed to each inside surface of the front wheels by a leaf-spring as a buffer. During a time that the receiver is receiving the electric wave from the transmitter, the electromagnet works and either one of the magnet cores that is closer to one of the brake disks sticks to the one brake disk. Therefore, the front wheel is braked and the car runs while turning to the braked side and changing alternately a turning direction by each transmission of the electric wave.

(2) U.S. Pat. No. 4,846,752 to Combs.

U.S. Pat. No. 4,846,752 issued to Combs on Jul. 11, 1989 in class 446 and subclass 279 teaches a remote controlled rolling skating toy wherein a female figure has formed internally thereof a plurality of batteries for supplying power to a remote control signal receiving device to selectively actuate a plurality of motors positioned in the torso portion of the figure for appropriate and desired weight distribution thereof and wherein a plurality of driven roller chains are positioned through either leg of the figure cooperating with a plurality of tension rollers to drive each of a plurality of roller skates integrally secured to each foot of the associated figure.

(3) U.S. Pat. No. 5,236,058 to Yamet et al.

U.S. Pat. No. 5,236,058 issued to Yamet et al. on Aug. 17, 1995 in class 180 and subclass 181 teaches a combination of a conventional roller skate having a platform supporting the skater and axles/wheels below the supporting platform that are mounted in rotational relationship to the platform and a motor is adapted to drive the wheels. In this combination, there is provided a braking system that is operatively associated with the wheels and/or axles and which is operated by hingedly depressing a forward portion of the support platform by way of the forward portion of the skater's foot, such as the toes. Depressing the forward portion of the support platform forces a braking apparatus into effective stopping contact with the wheels. There is further provided apparatus to start the motor, which is associated with the skate. In this embodiment, an auxiliary wheel is provided rearwardly of the skate and out of contact with the surface on which the skate wheels bear. The skater starts skating in a conventional manner, and when enough speed has been achieved, the skate is pivoted about the rear wheels to cause the auxiliary wheel to contact the surface on which the conventional wheels bear. This contact turns the auxiliary wheel, which jump starts the motor.

(4) U.S. Pat. No. 5,330,026 to Hsu et al.

U.S. Pat. No. 5,330,026 issued to Hsu et al. on Jul. 19, 1994 in class 180 and subclass 181 teaches a remote controlled electric skate-board having a motor to drive two sets of sun and planet gear units connected with a pair of rollers rotated to move the skate-board by a remote controller transmitting a signal to an electronic circuit carried on the board to start or to stop the motor so that the skate-board may be moved or stopped by electric power in addition to human force.

(5) U.S. Pat. No. 5,722,873 to Ishimoto.

U.S. Pat. No. 5,722,873 issued to Ishimoto on Mar. 3, 1998 in class 446 and subclass 456 teaches a steering system provided on a chassis of a toy car. A rotatable steering plate is rotatably provided on the chassis so as to rotate in a horizontal plane by a predetermined maximum angle toward left and right directions from a longitudinal center axis of the chassis. A spring member is provided on the chassis and mechanically connected to the rotatable steering plate at a position spaced-apart from the longitudinal center axis of the chassis for forcing the rotatable steering plate to rotate and tilt toward one of the left and right directions from the longitudinal center axis of the chassis. A steering motor is provided on the chassis for generating a rotation power, and has a motor shaft. A rotary shaft is provided on the chassis. A transmission system mechanically connects the motor shaft and the rotary shaft for transmitting the rotation power generated by the steering motor into the rotary shaft. A first wheel is so mechanically connected to a first end of the rotary shaft that the first wheel is allowed to rotate freely from the rotary shaft. A second wheel is mechanically connected to a second end of the rotary shaft. The second wheel has a clutch mechanism so operating that if the steering motor is driven, then the rotation power is transmitted to the second wheel and thus the second wheel is driven, whereby the rotatable steering plate is forced to direct in parallel to the longitudinal center axis of the chassis. If, however, the steering motor is not driven, then the rotation power generated by the steering motor is not transmitted to the second wheel and thus the second wheel is not driven and does not rotate or rotates by inertia freely from the rotary shaft, whereby the rotatable steering plate is forced to rotate and tilt toward the one of the left and right directions from the longitudinal center axis of the chassis.

(6) U.S. Pat. No. 5,797,466 to Gendle.

U.S. Pat. No. 5,797,466 issued to Gendle on Aug. 25, 1998 in class 180 and subclass 181 teaches a powered skate having a small motor mounted on an in-line roller blade with a hand-held throttle. The motor, such as a small internal combustion engine, is mounted at the rear of an in-line skate having a frame secured to a user's shoe or boot and drives the rear roller via a reduction gear train that may include a clutch assembly. The engine is started by a pull cord, and the engine speed is controlled by a hand-held control unit attached to the engine via a throttle cable that may be secured to the user's body via arm and leg straps. The powered in-line skate and a non-powered in-line skate can safely drive a user to speeds of about 20 MPH, this providing alternate transportation for the user.

(7) U.S. Pat. No. 5,829,543 to Diaz.

U.S. Pat. No. 5,829,543 issued to Diaz on Nov. 3, 1998 in class 180 and subclass 181 teaches a motorized in-line blade roller skate having a longitudinally extending chassis plate with rear and front ends and several in-line blade roller members. A motor provides the necessary rotational movement that is transmitted through a cable to a gear assembly that in turn transmits it to a driving roller member. A bracket member is pivotally mounted to the rear end of the chassis plate, and the driving roller member is rotatably mounted to the bracket. A clutch cable brings the driving roller member in contact with the rearmost roller member and thus transmits the rotational movement to the latter. A second pivotally mounted bracket is provided for rotatably supporting the rear roller and which is rigidly kept in place with an adjustable linkage member. Adjusting this linkage member offsets the wear and tear of the rear or driven roller and also permits a user to enhance gripping, preventing slip action, by bringing the rear roller member slightly below the plane defined by the other roller members.

(8) United States Patent Application Publication Number 2003/0214103 to Walker.

United States Patent Application Publication Number 2003/0214103 published to Walker on Nov. 20, 2003 in class 280 and subclass 11.203 teaches a handheld radio controlled transmitter communicating with an electrical circuit board on each skate. The electrical circuit controls one battery powered DC motor linear actuator driven hydraulic pump. The hydraulic pressure created from the hydraulic pump is directly related to how much electrical current is consumed by the DC motor. The electrical current is monitored, and the DC motor will move forward creating hydraulic pressure or move in reverse removing pressure. The hydraulic pressure depends on how far down or up the transmitter button is pressed. The hydraulic pump is connected to a lead screw and master piston. The hydraulic fluid travels from the master cylinder through tubing to a pair of slave cylinders on each wheel. The slave cylinders press against the disc brake pads that press against the in-line wheel hub when the skater needs to slow or stop.

(9) United States Patent Application Publication Number 2004/0163867 to Hillman.

United States Patent Application Publication Number 2004/0163867 published to Hillman on Aug. 26, 2004 in class 180 and subclass 180 teaches a vehicle for transporting a rider, including a platform for supporting the rider and at least one skate truck coupled to the platform and including a housing. An axle included in the skate truck extends through the housing to support a wheel having a rotational relationship with both the housing and the platform. Motive power rotates the wheel relative to the platform. A free-wheel bearing includes first portions coupled to the wheel and second portions coupled to the motive power. The second portions of the bearing have a fixed relationship with the first portions of the bearing when rotated in a first relative direction, and have a free-wheeling relationship with the first portions of the bearing when rotated in a second relative direction opposite to the first relative direction. When the motive power includes a motor, portions of the platform can be adapted to receive a battery.

It is apparent that numerous innovations for motor driven skates, skate boards, and toy cars and skates have been provided in the prior art that are adapted to be used. Furthermore, even though these innovations may be suitable for the specific individual purposes to which they address, they would not be suitable for the purposes of the present invention as heretofore described, namely, battery-powered, remote-controlled, motor-driven, steerable roller skates.

2. SUMMARY OF THE INVENTION

Thus, it is an object of the present invention to provide battery-powered, remote-controlled, motor-driven, steerable roller skates that avoid the disadvantages of the prior art.

Briefly stated, another object of the present invention is to provide battery-powered, remote-controlled, motor-driven, steerable roller skates. Each skate includes a boot, a transmitter, a base, a driving mechanism, a steering mechanism, a controller, and a receiver. The boot is worn on a foot of a user. The transmitter is battery-powered, is held by the user, and transmits wireless signals for controlling speed, steering, forward and reverse motion, and combinations thereof. The base has the boot sitting thereon. The driving mechanism is battery-powered, motor-driven, and operatively connected to, and selectively moves, the base with the boot thereon. The steering mechanism is battery-powered, motor-driven, and operatively connected to, and selectively steers, the base with the boot thereon. The controller is battery powered, disposed in the base, and operatively connected to, and selectively activates, the driving mechanism and the steering mechanism. The receiver is battery-powered, disposed in the base, and operatively connected to, and selectively activates, the controller by receipt of the wireless signals from the transmitter so as to allow the base with the boot thereon to move and steer by remote-control.

The novel features being considered characteristic of the present invention are set forth in the appended claims. The invention itself, however, both as to its construction and its method of operation together with additional objects and advantages thereof will be best understood from the following description of the specific embodiment when read and understood in connection with the accompanying drawing.

3. BRIEF DESCRIPTION OF THE DRAWING

The figures of the drawing are briefly described as follows.

Figure 2:
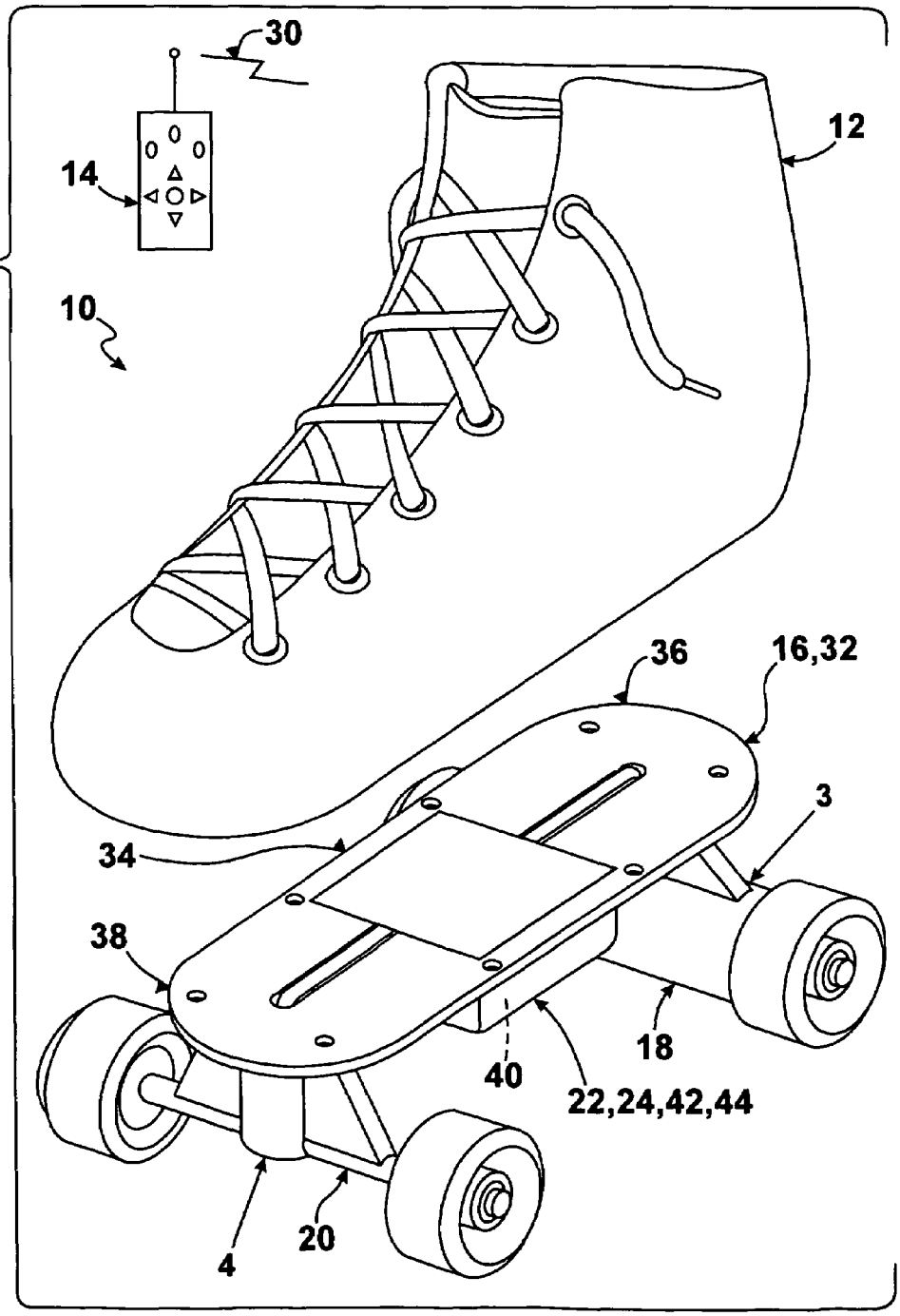
FIG. 2 is an enlarged exploded diagrammatic perspective view of each battery-powered, remote-controlled, motor-driven, steerable roller skate of the present invention identified by ARROW 2 in FIG. 1.
Figure 3:
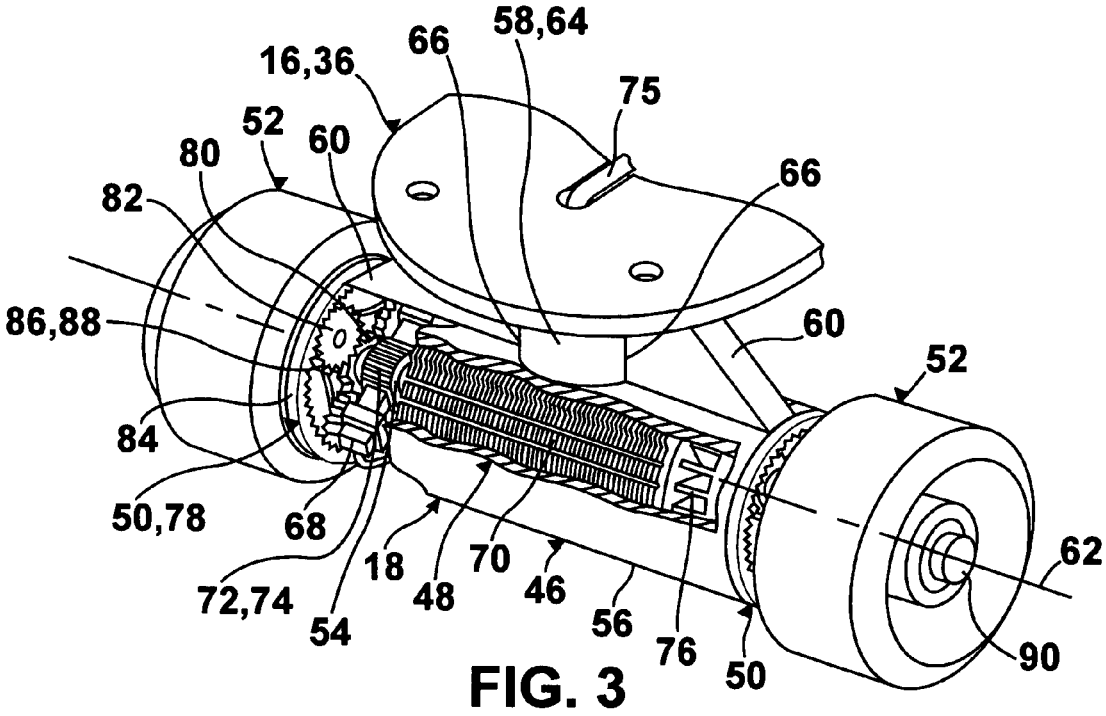
Figure 4:
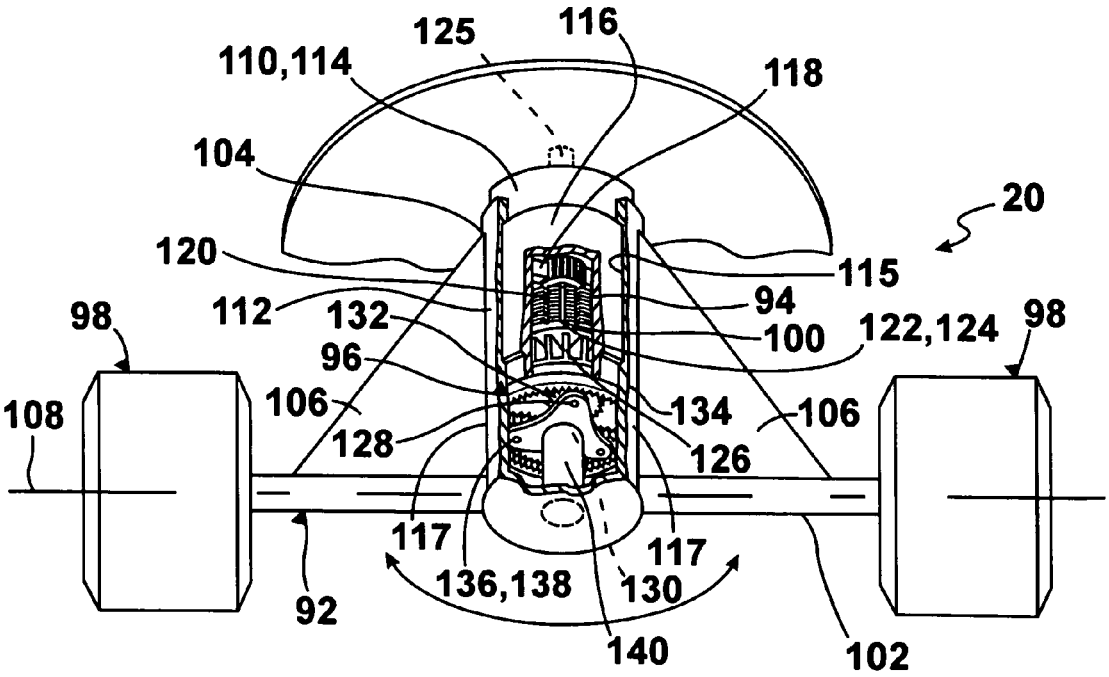

FIG. 3 is an enlarged diagrammatic perspective view of the driving mechanism of each of the battery-powered, remote-controlled, motor-driven, steerable roller skates of the present invention identified by ARROW 3 in FIG. 2; and FIG. 4 is an enlarged diagrammatic perspective view of the steering mechanism of each of the battery-powered, remote-controlled, motor-driven, steerable roller skates of the present invention identified by ARROW 4 in FIG. 2.

4. LIST OF REFERENCE NUMERALS UTILIZED IN THE DRAWING

A. General

10 battery-powered, remote-controlled, motor-driven, steerable roller skates of present invention B. Overall Configuration.

12 boot for wearing on foot 26 of user 28
14 transmitter for holding by user 28
16 base
18 driving mechanism
20 steering mechanism
22 controller
24 receiver
26 foot of user 28
28 user
30 wireless signals transmitted by transmitter 14 for controlling speed, steering, forward and reverse motion, and combinations thereof C. Base 16.

32 sole of base 16
34 generally center portion of base 16
36 generally rear portion of base 16
38 generally front portion of base 16
40 chamber in generally center portion 34 of base 16
42 battery interface for interfacing with batteries 44 for powering battery-powered, remote-controlled, motor-driven, steerable roller skate 10
44 batteries for powering battery-powered, remote-controlled, motor-driven, steerable roller skate 10

D. Driving Mechanism 16.

46 housing of driving mechanism 16
48 motor of driving mechanism 16
50 pair of gear drives of driving mechanism 16
52 pair of wheels of driving mechanism 16
54 ends of motor 48 of driving mechanism 16

(1) Housing 46 of Driving Mechanism 16.

56 generally horizontal portion of housing 46 of driving mechanism 16
58 generally vertical portion of housing 46 of driving mechanism 16
60 pair of reinforcing ribs of housing 46 of driving mechanism 16

62 axis of generally horizontal portion 56 of housing 46 of driving mechanism 16
64 support post of generally vertical portion 58 of housing 46 of driving mechanism 16
66 opposite sides of generally vertical portion 58 of housing 46 of driving mechanism 16

(2) Motor 48 of Driving Mechanism 16.
68 brushes of motor 48 of driving mechanism 16
70 rotor of motor 48 of driving mechanism 16
72 shaft of rotor 70 of motor 48 of driving mechanism 16
74 pair of ends of shaft 72 of rotor 70 of motor 48 of driving mechanism 16
75 cable of motor 48 of driving mechanism 16
76 cooling fan of driving mechanism 16

(3) Pair of Gear Drives 50 of Driving Mechanism 16.
78 planetary gear set of each gear drive of pair of gear drives 50 of driving mechanism 16
80 sun gear of planetary gear set 78 of each gear drive of pair of gear drives 50 of driving mechanism 16
82 three planetary gears of planetary gear set 78 of each gear drive of pair of gear drives 50 of driving mechanism 16
84 ring gear of planetary gear set 78 of each gear drive of pair of gear drives 50 of driving mechanism 16
86 corners of generally triangular plate 88 of planetary gear set 78 of each gear drive of pair of gear drives 50 of driving mechanism 16
88 generally triangular plate of planetary gear set 78 of each gear drive of pair of gear drives 50 of driving mechanism 16
90 stub shaft extending centrally and axially outwardly from generally triangular plate 88 of planetary gear set 78 of each gear drive of pair of gear drives 50 of driving mechanism 16

E. Steering Mechanism 20.
92 housing of steering mechanism 20
94 motor of steering mechanism 20
96 gear drive of steering mechanism 20
98 pair of wheels of steering mechanism 20
100 end of motor 94 of steering mechanism 20

(1) Housing 92 of Steering Mechanism 20.
102 generally horizontal portion of housing 92 of steering mechanism 20
104 generally vertical portion of housing 92 of steering mechanism 20
106 pair of reinforcing ribs of housing 92 of steering mechanism 20
108 axis of generally horizontal portion 102 of housing 92 of steering mechanism 20
110 stationary portion of generally vertical portion 104 of housing 92 of steering mechanism 20
112 movable portion of housing 92 of generally vertical portion 104 of steering mechanism 20
114 support post of stationary portion 110 of generally vertical portion 104 of housing 92 of steering mechanism 20
115 groove extending partially around in movable portion 112 of generally vertical portion 104 of housing 92 of steering mechanism 20
116 tab extending partially around stationary portion 110 of housing 92 of steering mechanism 20
117 opposite sides of movable portion 112 of generally vertical portion 104 of housing 92 of steering mechanism 20

(2) Motor 94 of Steering Mechanism 20.
118 brushes of motor 94 of steering mechanism 20
120 rotor of motor 94 of steering mechanism 20
122 shaft of rotor 120 of motor 94 of steering mechanism 20
124 pair of ends of shaft 122 of rotor 120 of motor 94 of steering mechanism 20
125 cable of motor 94 of steering mechanism 20
126 cooling fan of steering mechanism 20

(3) Gear Drive 96 of Steering Mechanism 20.
128 planetary gear set of gear drive 96 of steering mechanism 20
130 sun gear of planetary gear set 128 of gear drive 96 of steering mechanism 20
132 three planetary gears of planetary gear set 128 of gear drive 96 of steering mechanism 20
134 ring gear of planetary gear set 128 of gear drive 96 of steering mechanism 20
136 corners of generally triangular plate 138 of gear drive 96 of steering mechanism 20
138 generally triangular plate of gear drive 96 of steering mechanism 20
140 stub shaft extending centrally and axially outwardly from generally triangular plate 138 of gear drive 96 of steering mechanism 20

5. DETAILED DESCRIPTION OF THE PREFERRED EMBODIMENT

A. General

Figure 1:
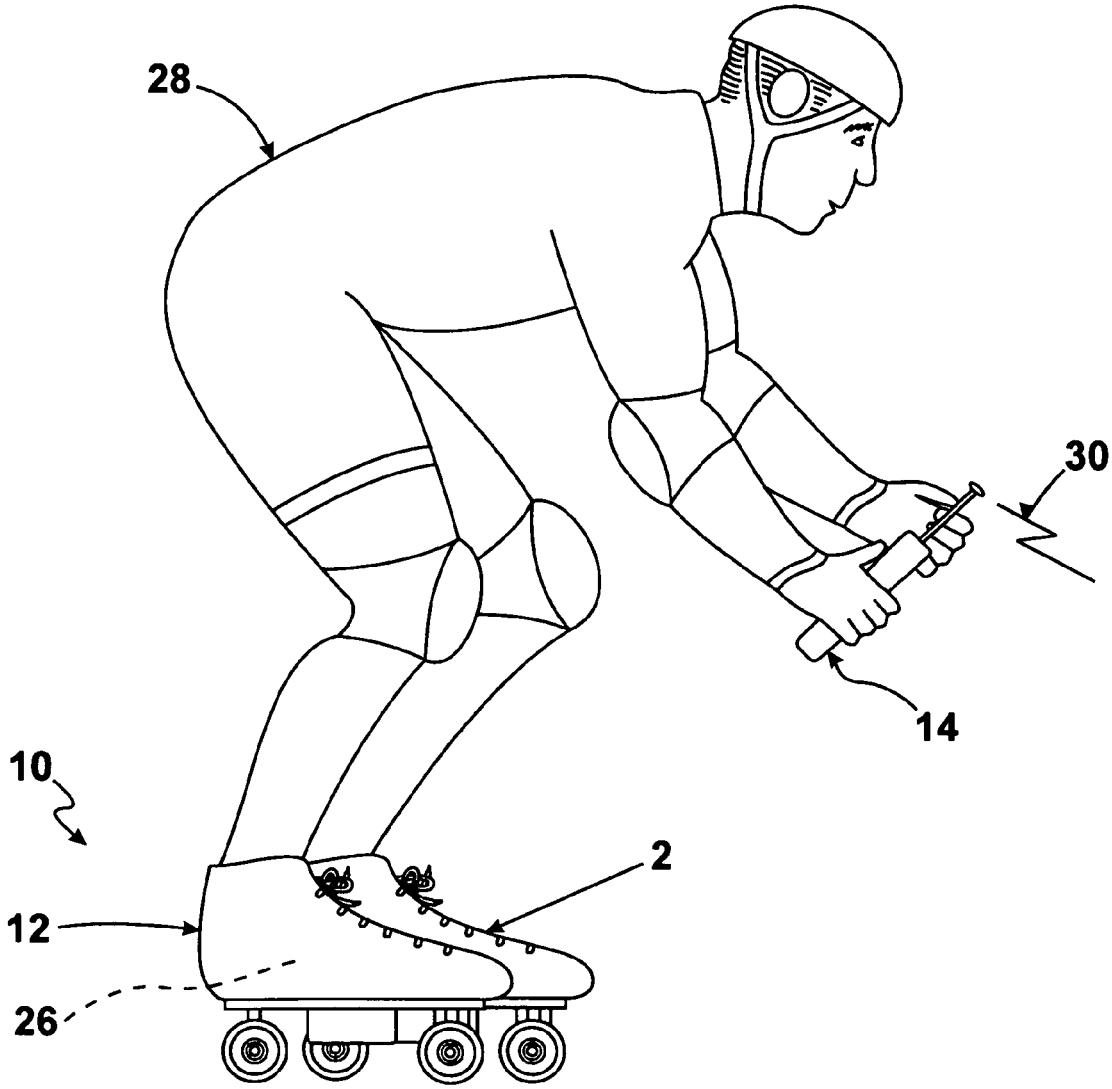
FIG. 1 is a diagrammatic perspective view of the battery-powered, remote-controlled, motor-driven, steerable roller skates of the present invention in use.

Referring now to the figures, in which like numerals indicate like parts, and particularly to FIG. 1, which is a diagrammatic perspective view of the battery-powered, remote-controlled, motor-driven, steerable roller skates of the present invention in use, the battery-powered, remote-controlled, motor-driven, steerable roller skates of the present invention are shown generally at 10.

B. Overall Configuration

The overall configuration of each of the battery-powered, remote-controlled, motor-driven, steerable roller skates 10 can best be seen in FIG. 2, which is an enlarged exploded diagrammatic perspective view of each battery-powered, remote-controlled, motor-driven, steerable roller skate of the present invention identified by ARROW 2 in FIG. 1, and as such, will be discussed with reference thereto.

Each battery-powered, remote-controlled, motor-driven, steerable roller skate 10 comprises a boot 12, a transmitter 14, a base 16, a driving mechanism 18, a steering mechanism 20, a controller 22, and a receiver 24.

The boot 12 is for wearing on a foot 26 of a user 28 (FIG. 1). The transmitter 14 is battery-powered, is for holding by the user 28 (FIG. 1), and transmits wireless signals 30 (FIG. 1) for controlling speed, steering, forward and reverse motion, and combinations thereof. The base 16 has the boot 12 sitting thereon. The driving mechanism 18 is battery-powered, motor-driven, and operatively connected to, and selectively moves, the base 16 with the boot 12 thereon. The steering mechanism 20 is battery-powered, motor-driven, and operatively connected to, and selectively steers, the base 16 with the boot 12 thereon. The controller 22 is battery powered, disposed in the base 16, and operatively connected to, and selectively activates, the driving mechanism 18 and the steering mechanism 20. The receiver 24 is battery-powered, disposed in the base 16, and operatively connected to, and selectively activates, the controller 22 by receipt of the wireless signals 30 from the transmitter 14 so as to allow the base 16 with the boot 12 thereon to move and steer by remote-control.

C. The base 16

The base 16 is generally flat, forms a sole 32 of, and attaches to, the boot 12, and has a generally center portion 34, a generally rear portion 36, and a generally front portion 38.

The generally center portion 34 of the base 16 has a chamber 40 depending therefrom. The chamber 40 in the base 16 houses the controller 22, the receiver 24, and a battery interface 42. The battery interface 42 is for interfacing with batteries 44 for powering the battery-powered, remote-controlled, motor-driven, steerable roller skate 10.

D. The Driving Mechanism 18

The specific configuration of the driving mechanism 18 can best be seen in FIG. 3, which is an enlarged diagrammatic perspective view of the driving mechanism of each of the battery-powered, remote-controlled, motor-driven, steerable roller skates of the present invention identified by ARROW 3 in FIG. 2, and as such, will be discussed with reference thereto.

The driving mechanism 18 comprises a housing 46, a motor 48, a pair of gear drives 50, and a pair of wheels 52. The housing 46 of the driving mechanism 18 depends from the generally rear portion 36 of the base 16, and houses the motor 48 of the driving mechanism 18. The pair of gear drives 50 of the driving mechanism 18 are operatively connected to respective ends 54 of the motor 48 of the driving mechanism 18. The pair of wheels 52 of the driving mechanism 18 are operatively connected to the pair of gear drives 50 of the driving mechanism 18, respectively.

(1) The Housing 46 of the Driving Mechanism 18.

The housing 46 of the driving mechanism 18 comprises a generally horizontal portion 56, a generally vertical portion 58, and a pair of reinforcing ribs 60. The generally horizontal portion 56 of the housing 46 of the driving mechanism 18 is generally cylindrically-shaped, has an axis 62, and houses the motor 48 of the driving mechanism 18. The generally vertical portion 58 of the housing 46 of the driving mechanism 18 forms a support post 64 that suspends the generally horizontal portion 56 of the housing 46 of the driving mechanism 18 from the generally rear portion 36 of the base 16. The pair of reinforcing ribs 60 of the housing 46 of the driving mechanism 18 are generally triangular-shaped and extend from opposite sides 66 of the generally vertical portion 58 of the housing 46 of the driving mechanism 18 to, and along the axis 62 of, the generally horizontal portion 56 of the housing 46 of the driving mechanism 18.

(2) The Motor 48 of the Driving Mechanism 18.

The motor 48 of the driving mechanism 16 comprises brushes 68, and a rotor 70 with a shaft 72 having a pair of ends 74. The motor 48 of the driving mechanism 18 is in electrical communication with the controller 22 via a cable 75. One end 74 of the shaft 72 of the rotor 70 of the motor 48 of the driving mechanism 18 is operatively connected to a cooling fan 76 and then to one gear drive 50 of the driving mechanism 18, and the other end 74 of the shaft 72 of the rotor 70 of the motor 48 of the driving mechanism 18 is operatively connected to the other gear drive 50 of the driving mechanism 18.

(3) The Pair of Gear Drives 50 of the Driving Mechanism 18.

Each gear drive 50 of the driving mechanism 18 comprises a planetary gear set 78 comprising a sun gear 80, three planetary gears 82 operatively connected to the sun gear 80 of the planetary gear set 78 of an associated gear drive 50 of the driving mechanism 18, and a ring gear 84 operatively connected to the three planetary gears 82 of the planetary gear set 78 of the associated gear drive 50 of the driving mechanism 18.

The planetary gear set 78 of each gear drive 50 of the driving mechanism 18 has gear ratios for increasing torque for allowing the battery-powered, remote-controlled, motor-driven, steerable roller skate 10 with the foot 26 of the user 28 therein to move.

The sun gear 80 of the planetary gear set 78 of an associated gear drive 50 of the driving mechanism 18 is disposed on, and rotates with, a respective end 74 of the shaft 72 of the planetary gear set 78 of the associated gear drive 50 of the driving mechanism 18. The three planetary gears 82 of the planetary gear set 78 of the associated gear drive 50 of the driving mechanism 18 are rotatably attached to corners 86 of a generally triangular plate 88 having a stub shaft 90 extending centrally and axially outwardly therefrom to, and to rotate, a respective wheel 52 of the driving mechanism 18. The ring gear 84 of the planetary gear set 78 of the associated gear drive 50 of the driving mechanism 18 is stationarily affixed to the generally horizontal portion 56 of the housing 46 of the driving mechanism 18 so as to allow the three planetary gears 82 of the planetary gear set 78 of the associated gear drive 50 of the driving mechanism 18 to rotate around the sun gear 80 of the planetary gear set 78 of the associated gear drive 50 of the driving mechanism 18 and also around in the ring gear 84 of the planetary gear set 78 of the associated gear drive 50 of the driving mechanism 18.

E. The Steering Mechanism 20

The specific configuration of the steering mechanism 20 can best be seen in FIG. 4, which is an enlarged diagrammatic perspective view of the steering mechanism of each of the battery-powered, remote-controlled, motor-driven, steerable roller skates of the present invention identified by ARROW 4 in FIG. 2, and as such, will be discussed with reference thereto.

The steering mechanism 20 comprises a housing 92, a motor 94, a gear drive 96, and a pair of wheels 98. The housing 92 of the steering mechanism 20 depends from the generally front portion 38 of the base 16, and houses the motor 94 of the steering mechanism 20. The gear drive 96 of the steering mechanism 20 is operatively connected to an end 100 of the motor 94 of the steering mechanism 20. The pair of wheels 98 of the steering mechanism 20 are operatively connected to the housing 92 of the steering mechanism 20.

(1) The Housing 92 of the Steering Mechanism 20.

The housing 92 of the steering mechanism 20 comprises a generally horizontal portion 102, a generally vertical portion 104, and a pair of reinforcing ribs 106. The generally horizontal portion 102 of the housing 92 of the steering mechanism 20 is generally cylindrically-shaped and has an axis 108. The generally vertical portion 104 of the housing 92 of the steering mechanism 20 comprises a stationary portion 110 and a movable portion 112. The stationary portion 110 of the generally vertical portion 104 of the housing 92 of the steering mechanism 20 forms a support post 114 stationarily housing the motor 94 of the steering mechanism 20. The movable portion 112 of the generally vertical portion 104 of the housing 92 of the steering mechanism 20 is rotatably attached to, and receives, the stationary portion 110 of the housing 92 of the steering mechanism 20 by having a groove 115 extending partially therearound rotatably receiving a tab 116 extending partially around the stationary portion 110 of the generally vertical portion 104 of the housing 92 of the steering mechanism 20, and suspends the generally horizontal portion 102 of the housing 92 of the steering mechanism 20 from the generally front portion 38 of the base 16.

The extend of the groove 115 extending partially around in the movable portion 112 of the generally vertical portion 104 of the housing 92 of the steering mechanism and the tab 116 extending partially around the stationary portion 110 of the generally vertical portion 104 of the housing 92 of the steering mechanism 20 determine the turning radius of the steering mechanism 20.

The pair of reinforcing ribs 106 of the housing 92 of the steering mechanism 20 are generally triangular-shaped and extend from opposite sides 117 of the movable portion 112 of the generally vertical portion 104 of the housing 92 of the steering mechanism 20 to, and along the axis 108 of, the generally horizontal portion 102 of the housing 92 of the steering mechanism 20.

(2) The Motor 94 of the Steering Mechanism 20.

The motor 94 of the steering mechanism 20 comprises brushes 118, and a rotor 120 with a shaft 122 having a pair of ends 124. The motor 94 of the steering mechanism 20 is in electrical communication with the controller 22 via a cable 125. One end 124 of the shaft 122 of the rotor 120 of the motor 94 of the steering mechanism 20 is operatively connected to a cooling fan 126, and the other end 114 of the shaft 122 of the rotor 120 of the motor 94 of the steering mechanism 20 is operatively connected to the gear drive 96 of the steering mechanism 20.

(3) The gear drive 96 of the steering mechanism 20.

The gear drive 96 of the steering mechanism 20 comprises a planetary gear set 128 comprising a sun gear 130, three planetary gears 132 operatively connected to the sun gear 130 of the planetary gear set 128 of the gear drive 96 of the steering mechanism 20, and a ring gear 134 operatively connected to the three planetary gears 132 of the planetary gear set 128 of the gear drive 96 of the steering mechanism 20.

The planetary gear set 128 of the gear drive 96 of the steering mechanism 20 has gear ratios for increasing torque for allowing the battery-powered, remote-controlled, motor-driven, steerable roller skate 10 with the foot 26 of the user 28 therein to steer.

The sun gear 130 of the planetary gear set 128 of the gear drive 96 of the steering mechanism 20 is disposed on, and rotates with, the other end 114 of the shaft 122 of the rotor 120 of the motor 94 of the steering mechanism 20. The three planetary gears 132 of the planetary gear set 128 of the gear drive 96 of the steering mechanism 20 are rotatably attached to corners 136 of a generally triangular plate 138 having a stub shaft 140 extending centrally and axially outwardly therefrom to, and to rotate, the movable portion 112 of the generally vertical portion 104 of the housing 92 of the steering mechanism 20 so as to allow the pair of wheels 98 of the steering mechanism 20 to steer. The ring gear 134 of the planetary gear set 128 of the gear drive 96 of the steering mechanism 20 is stationarily affixed to the stationary portion 110 of the generally vertical portion 104 of the housing 92 of the steering mechanism 20 so as to allow the three planetary gears 132 of the planetary gear set 128 of the gear drive 96 of the steering mechanism 20 to rotate around the sun gear 130 of the planetary gear set 128 of the gear drive 96 of the steering mechanism 20 and also around in the ring gear 134 of the planetary gear set 128 of the gear drive 96 of the steering mechanism 20.

F. Conclusions

It will be understood that each of the elements described above or two or more together may also find a useful application in other types of constructions differing from the types described above.

While the invention has been illustrated and described as embodied in battery-powered, remote-controlled, motor-driven, steerable roller skates, however, it is not limited to the details shown, since it will be understood that various omissions, modifications, substitutions, and changes in the forms and details of the device illustrated and its operation can be made by those skilled in the art without departing in any way from the spirit of the present invention.

Without further analysis the foregoing will so fully reveal the gist of the present invention that others can by applying current knowledge readily adapt it for various applications without omitting features that from the standpoint of prior art fairly constitute characteristics of the generic or specific aspects of the invention.

The invention claimed is as follows:

1. Battery-powered, remote-controlled, motor-driven, steerable roller skates, each of which comprising:

a) a boot;
b) a transmitter;
c) a base;
d) a driving mechanism;
e) a steering mechanism;
f) a controller; and
g) a receiver;

wherein said boot is for wearing on a foot of a user;
wherein said transmitter is battery-powered;
wherein said transmitter is for holding by the user;
wherein said transmitter transmits wireless signals;
wherein said wireless signals are for controlling speed, steering, forward and reverse motion, and combinations thereof;
wherein said base has said boot sitting thereon;
wherein said driving mechanism is battery-powered;
wherein said driving mechanism is motor-driven;
wherein said driving mechanism is operatively connected to, and selectively moves, said base with said boot thereon;
wherein said steering mechanism is battery-powered;
wherein said steering mechanism is motor-driven;
wherein said steering mechanism is operatively connected to, and selectively steers, said base with said boot thereon;
wherein said controller is battery powered;
wherein said controller is disposed in said base;
wherein said controller is operatively connected to, and selectively activates, said driving mechanism and said steering mechanism;
wherein said receiver is battery-powered;
wherein said receiver is disposed in said base;
wherein said receiver is operatively connected to, and selectively activates, said controller by receipt of said wireless signals from said transmitter so as to allow said base with said boot thereon to move and steer by remote-control;

wherein said base forms a sole of, and attaches to, said boot;

wherein said base has a generally center portion;

wherein said base has a generally rear portion;

wherein said base has a generally front portion;

wherein said steering mechanism comprises a housing;

wherein said steering mechanism comprises a motor;

wherein said steering mechanism comprises a gear drive;

wherein said steering mechanism comprises a pair of wheels;

wherein said housing of said steering mechanism depends from said generally front portion of said base;

wherein said housing of said steering mechanism houses said motor of said steering mechanism;

wherein said gear drive of said steering mechanism is operatively connected to an end of said motor of said steering mechanism; and wherein said pair of wheels of said steering mechanism are operatively connected to said housing of said steering mechanism.

2. The skate of claim 1, wherein said generally center portion of said base has a chamber depending therefrom;

wherein said chamber in said base houses said controller;

wherein said chamber in said base houses said receiver;

wherein said chamber in said base houses a battery interface; and wherein said battery interface is for interfacing with batteries for powering said battery-powered, remote-controlled, motor-driven, steerable roller skate.

3. The skate of claim 1, wherein said driving mechanism comprises a housing;

wherein said driving mechanism comprises a motor;

wherein said driving mechanism comprises a pair of gear drives;

wherein said driving mechanism comprises a pair of wheels;

wherein said housing of said driving mechanism depends from said generally rear portion of said base;

wherein said housing of said driving mechanism houses said motor of said driving mechanism;

wherein said pair of gear drives of said driving mechanism are operatively connected to respective ends of said motor of said driving mechanism; and wherein said pair of wheels of said driving mechanism are operatively connected to said pair of gear drives of said driving mechanism, respectively.

4. The skate of claim 3, wherein said housing of said driving mechanism comprises a generally horizontal portion;

wherein said housing of said driving mechanism comprises a generally vertical portion;

wherein said housing of said driving mechanism comprises a pair of reinforcing ribs;

wherein said generally horizontal portion of said housing of said driving mechanism has an axis;

wherein said generally horizontal portion of said housing of said driving mechanism stationarily houses said motor of said driving mechanism;

wherein said generally vertical portion of said housing of said driving mechanism forms a support post that suspends said generally horizontal portion of said housing of said driving mechanism from said generally rear portion of said base; and wherein said pair of reinforcing ribs of said housing of said driving mechanism extend from opposite sides of said generally vertical portion of said housing of said driving mechanism to, and along said axis of, said generally horizontal portion of said housing of said driving mechanism.

5. The skate of claim 3, wherein said motor of said driving mechanism is in electrical communication with said controller via a cable;

wherein said motor of said driving mechanism comprises brushes;

wherein said motor of said driving mechanism comprises a rotor;

wherein said rotor of said motor of said driving mechanism has a shaft;

wherein said shaft of said rotor of said motor of said driving mechanism has a pair of ends;

wherein one end of said shaft of said rotor of said motor of said driving mechanism is operatively connected to a cooling fan and then to one gear drive of said driving mechanism; and wherein the other end of said shaft of said rotor of said motor of said driving mechanism is operatively connected to the other gear drive of said driving mechanism.

6. The skate of claim 3, wherein each gear drive of said driving mechanism comprises a planetary gear set;

wherein said planetary gear set of each gear drive of said driving mechanism comprises a sun gear;

wherein said planetary gear set of each gear drive of said driving mechanism comprises three planetary gears operatively connected to said sun gear of said planetary gear set of an associated gear drive of said driving mechanism; and wherein said planetary gear set of each gear drive of said driving mechanism comprises a ring gear operatively connected to said three planetary gears of said planetary gear set of the associated gear drive of said driving mechanism;

wherein said sun gear of said planetary gear set of said associated gear drive of said driving mechanism is disposed on, and rotates with, a respective end of said shaft of said planetary gear set of said associated gear drive of said driving mechanism;

wherein said three planetary gears of said planetary gear set of said associated gear drive of said driving mechanism are rotatably attached to corners of a generally triangular plate having a stub shaft extending centrally and axially outwardly therefrom to, and to rotate, a respective wheel of said driving mechanism; and wherein said ring gear of said planetary gear set of said associated gear drive of said driving mechanism is stationarily affixed to said generally horizontal portion of said housing of said driving mechanism so as to allow said three planetary gears of said planetary gear set of said associated gear drive of said driving mechanism to rotate around said sun gear of said planetary gear set of said associated gear drive of said driving mechanism and also around in said ring gear of said planetary gear set of said associated gear drive of said driving mechanism.

7. The skate of claim 1, wherein said housing of said steering mechanism comprises a generally horizontal portion;

wherein said housing of said steering mechanism comprises a generally vertical portion;

wherein said housing of said steering mechanism comprises a pair of reinforcing ribs;

wherein said generally horizontal portion of said housing of said steering mechanism has an axis;

wherein said generally vertical portion of said housing of said steering mechanism comprises a stationary portion;

wherein said generally vertical portion of said housing of said steering mechanism comprises a movable portion;

wherein said stationary portion of said generally vertical portion of said housing of said steering mechanism forms a support post stationarily housing said motor of said steering mechanism;

wherein said movable portion of said generally vertical portion of said housing of said steering mechanism is rotatably attached to, and receives, said stationary portion of said housing of said steering mechanism by having a groove extending partially therearound rotatably receive a tab extending partially around said stationary portion of said generally vertical portion of said housing of said steering mechanism;

wherein said movable portion of said generally vertical portion of said housing of said steering mechanism suspends said generally horizontal portion of said housing of said steering mechanism from said generally front portion of said base; and wherein said pair of reinforcing ribs of said housing of said steering mechanism extend from opposite sides of said movable portion of said generally vertical portion of said housing of said steering mechanism to, and along said axis of, said generally horizontal portion of said housing of said steering mechanism.

8. The skate of claim 1, wherein said motor of said steering mechanism comprises brushes;

wherein said motor of said steering mechanism comprises a rotor;

wherein said rotor of said motor of said steering mechanism has a shaft;

wherein said shaft of said rotor of said motor of said steering mechanism has a pair of ends;

wherein said motor of said steering mechanism is in electrical communication with said controller via a cable;

wherein one end of said shaft of said rotor of said motor of said steering mechanism is operatively connected to a cooling fan; and wherein the other end of said shaft of said rotor of said motor of said steering mechanism is operatively connected to said gear drive of said steering mechanism.

9. The skate of claim 1, wherein said gear drive of said steering mechanism comprises a planetary gear set;

wherein said planetary gear set of said gear drive of said steering mechanism comprises a sun gear;

wherein said planetary gear set of said gear drive of said steering mechanism comprises three planetary gears operatively connected to said sun gear of said planetary gear set of said gear drive of said steering mechanism;

wherein said planetary gear set of said gear drive of said steering mechanism comprises a ring gear operatively connected to said three planetary gears of said planetary gear set of said gear drive of said steering mechanism;

wherein said sun gear of said planetary gear set of said gear drive of said steering mechanism is disposed on, and rotates with, the other end of said shaft of said rotor of said motor of said steering mechanism;

wherein said three planetary gears of said planetary gear set of said gear drive of said steering mechanism are rotatably attached to corners of a generally triangular plate having a stub shaft extending centrally and axially outwardly therefrom to, and to rotate, said movable portion of said generally vertical portion of said housing of said steering mechanism so as to allow said pair of wheels of said steering mechanism to steer; and wherein said ring gear of said planetary gear set of said gear drive of said steering mechanism is stationarily affixed to said stationary portion of said generally vertical portion of said housing of said steering mechanism so as to allow said three planetary gears of said planetary gear set of said gear drive of said steering mechanism to rotate around said sun gear of said planetary gear set of said gear drive of said steering mechanism and also around in said ring gear of said planetary gear set of said gear drive of said steering mechanism.

* * * * *